US010876287B2

(12) United States Patent
Caffaratti Giro

(10) Patent No.: US 10,876,287 B2
(45) Date of Patent: Dec. 29, 2020

(54) STRUCTURAL SYSTEM WITH ACOUSTIC INSULATION PROPERTIES

(71) Applicant: Dario Alejandro Caffaratti Giro, Madrid (ES)

(72) Inventor: Dario Alejandro Caffaratti Giro, Madrid (ES)

( * ) Notice: Subject to any disclaimer, the term of this patent is extended or adjusted under 35 U.S.C. 154(b) by 0 days.

(21) Appl. No.: 16/327,830

(22) PCT Filed: Aug. 18, 2017

(86) PCT No.: PCT/ES2017/070582

§ 371 (c)(1),
(2) Date: Feb. 24, 2019

(87) PCT Pub. No.: WO2018/042065

PCT Pub. Date: Mar. 8, 2018

(65) Prior Publication Data

US 2019/0194938 A1 Jun. 27, 2019

(30) Foreign Application Priority Data

Sep. 2, 2016 (ES) ..... 201631149

(51) Int. Cl.

| | |
|---|---|
| ***E04B 1/84*** | (2006.01) |
| ***E04H 1/12*** | (2006.01) |
| ***E04B 1/82*** | (2006.01) |
| ***E04B 1/348*** | (2006.01) |

(Continued)

(52) U.S. Cl.

CPC ..... *E04B 1/84* (2013.01); *E04B 1/348* (2013.01); *E04B 1/82* (2013.01); *E04B 1/99* (2013.01); *E04H 1/12* (2013.01); *E04B 1/61* (2013.01); *E04B 1/8218* (2013.01)

(58) Field of Classification Search

CPC . E04B 1/82; E04B 1/8218; E04B 1/84; E04B 1/88; E04B 1/99; E04B 1/348; E04B 2/02; E04B 2002/0243; E04B 1/61; E04B 1/2403; E04H 1/1216; E04H 1/1205; E04H 1/1266; E04H 1/1272

See application file for complete search history.

(56) References Cited

U.S. PATENT DOCUMENTS 3,363,383 A * 1/1968 La Barge ..... E04B 1/68 52/471
4,959,504 A * 9/1990 Yarger ..... H05K 9/0001 174/386

(Continued)

FOREIGN PATENT DOCUMENTS

CA 2765354 A1 * 7/2012 ..... E04B 2/00
CA 2881415 A1 * 2/2016 ..... E04B 1/86

(Continued)

*Primary Examiner* — Phi D A
(74) *Attorney, Agent, or Firm* — Patshegen IP LLC; Moshe Pinchas

(57) ABSTRACT

The invention relates to a structural system (1) with acoustic insulation properties, comprising modular mountable enclosures (2) for configuring a construction (3), the enclosures (2) comprising at least three layers (4, 5, 6) joined together by means of fasteners (*7a*, *7b*, *7c*) with discreet elastic elements, the system having at least one second layer (5) disposed in an intermediate position between the first layer (4) and the third layer (6).

11 Claims, 5 Drawing Sheets

(51) Int. Cl.
*E04B 1/99* (2006.01)
*E04B 1/61* (2006.01)

(56) References Cited

U.S. PATENT DOCUMENTS 4,964,250 A * 10/1990 Nelson ..... E04B 1/86 52/144
5,009,043 A * 4/1991 Kurrasch ..... E04B 1/8227 181/290
5,123,874 A * 6/1992 White, III ..... E04B 1/34321 181/290
5,220,760 A * 6/1993 Dimakis ..... B32B 5/18 52/309.9
5,260,525 A * 11/1993 Morse ..... E04B 1/8218 181/285
5,787,651 A * 8/1998 Horn ..... E04B 2/7412 52/144
6,119,411 A * 9/2000 Mateu Gil ..... E04B 1/94 109/80
6,122,867 A * 9/2000 Leconte ..... E04B 1/82 52/144
6,931,803 B1 * 8/2005 Davis ..... E04B 1/28 52/251
7,135,035 B1 * 11/2006 Dimmick ..... A61N 5/06 607/90
9,140,004 B2 * 9/2015 Hansen ..... E04B 1/84
9,512,621 B1 * 12/2016 Trezza ..... E04F 13/0803
9,963,875 B1 * 5/2018 Prygon ..... E04B 1/762
2005/0055927 A1 * 3/2005 Tiemann ..... F16B 13/00 52/459
2005/0064145 A1 * 3/2005 Hoie ..... E04B 7/22 428/167
2012/0174511 A1 * 7/2012 Harding ..... B66F 9/142 52/302.1
2012/0216476 A1 * 8/2012 Naidoo ..... E04B 1/14 52/309.4
2014/0000204 A1 * 1/2014 Wu ..... E04B 1/7629 52/506.05
2014/0345223 A1 * 11/2014 Miks ..... E04B 1/4171 52/309.4
2015/0093535 A1 * 4/2015 Lambach ..... E04C 2/386 428/71
2015/0275511 A1 * 10/2015 Hammer ..... E04B 2/7409 52/404.1
2016/0194868 A1 * 7/2016 DeBoer ..... E04B 2/32 52/604
2018/0148919 A1 * 5/2018 Rebollar Buldain ..... E04B 1/2403
2019/0119902 A1 * 4/2019 Chen ..... E04B 1/34321

FOREIGN PATENT DOCUMENTS

EP 3239421 A1 * 11/2017 ..... E04H 1/12
WO WO-2012016502 A1 * 2/2012 ..... E04B 1/762

* cited by examiner

STRUCTURAL SYSTEM WITH ACOUSTIC INSULATION PROPERTIES

PURPOSE OF THE INVENTION

This invention refers to a structural system with acoustic insulation properties.

BACKGROUND OF THE INVENTION

At present, several constructions are known with acoustic insulation properties, for example, cabins for hearing tests or for musical recordings, which comprise several layers of acoustic insulation material joined together by other layers of elastic material to obtain a mass-spring-mass system. These constructions present the disadvantage that the elastic material layers fully unite the surface of the other layers, making connections too rigid that adversely affect the properties of acoustic insulation.

On the other hand, the necessary structural strength of the construction involves rigid support elements that form acoustic bridges that are difficult to eliminate without jeopardising the stability of the construction.

DESCRIPTION OF THE INVENTION

The structural system with acoustic insulation properties of the invention has a configuration that minimises and eliminates the acoustic bridges, obtaining good structural stability and also allowing a modular assembly.

The system of the invention is of the type that comprises modular mountable enclosures to configure a construction, such as an acoustics cabin, a games room, or any room or acoustically insulated construction, where, according to the invention, the enclosures comprise at least three layers that are joined to each other through fasteners with discrete elastic elements, supporting at least, a second layer (cooperates in maintaining the structural stability of the construction), that is arranged in an intermediate position between the first layer and third layer.

In this document, discrete elastic elements are understood to be elements that only affect specific areas of the layers and not all of its surface.

In this way, the supporting layer is arranged between the other two, avoiding acoustic bridges, and, furthermore, the discrete elastic elements comprise point attachments that do not affect the entire surface so that greater independence between layers is obtained at a lower cost. Furthermore, since the supporting intermediate layer is ideally made of a material with acoustic insulation properties, such as wood or derivatives, a triple layer of isolation is obtained, with a double mass-spring-mass system, which improves the level of isolation.

DESCRIPTION OF A PRACTICAL EMBODIMENT OF THE INVENTION

Figure 1:
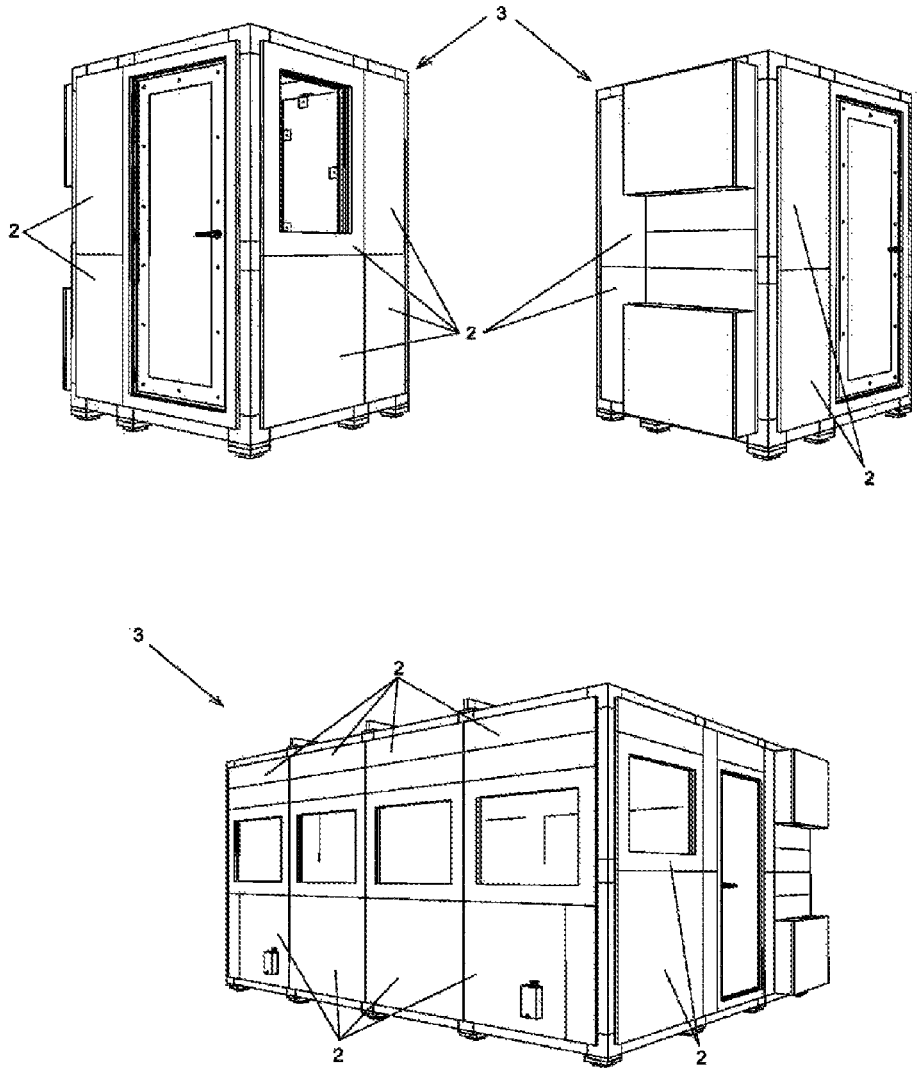
FIG. 1 shows three views, where the two upper views correspond to an acoustics cabin from two different points of view, and the third view corresponds to a larger construction, such as a playroom for children.
Figure 2:
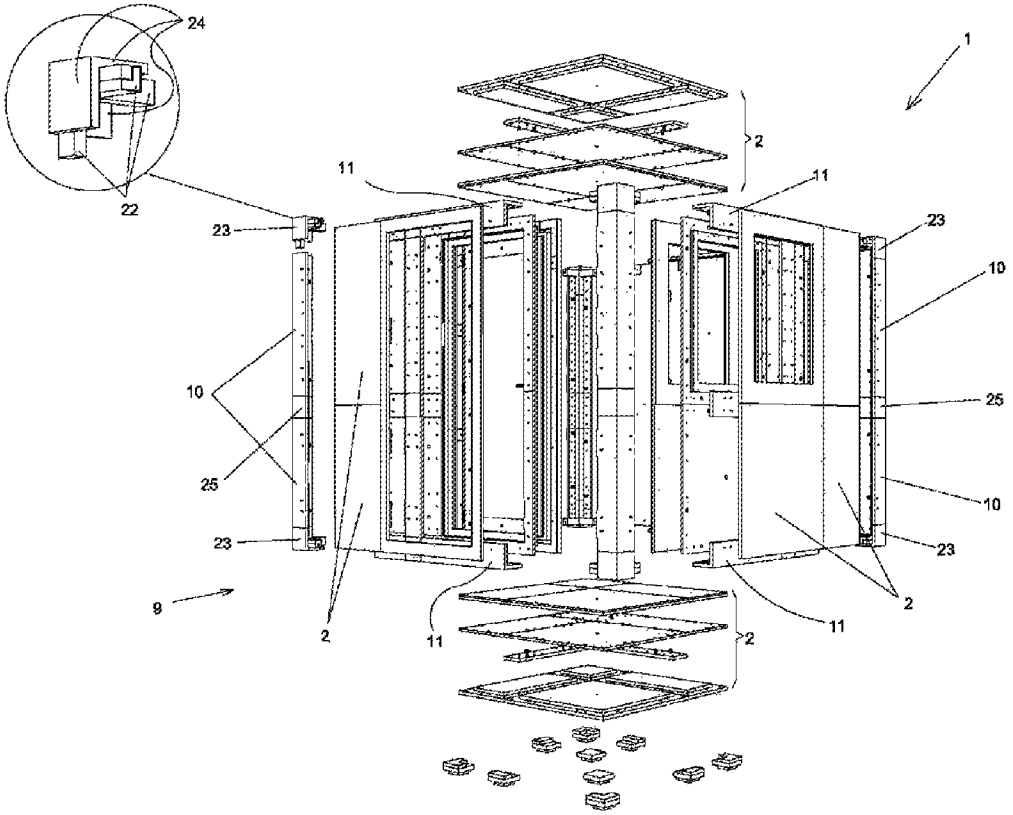
FIG. 2 shows an exploded view of the cabin shown in FIG. 1 and an expanded detail of a primary connector of the structure.
Figure 3:
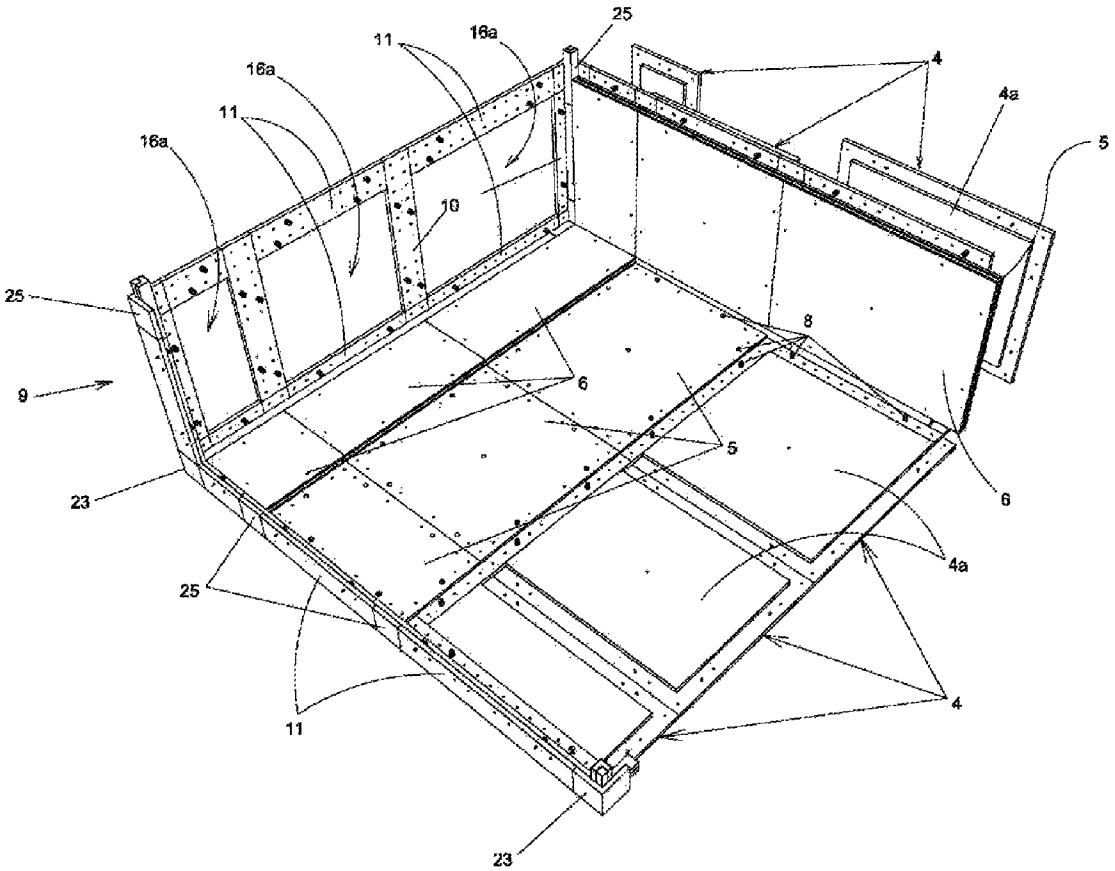
FIG. 3 shows a partial detail of an enclosure floor and walls of a construction made according to the invention system, where three floor sections can be seen with three visible layers of the system, and on the right can be seen the outer layer with the different layers assembled or partially disassembled.

The structural system (1) with acoustic insulation properties of the invention is of the type that comprises various modular mountable enclosures (2) to configure a construction (3) (see FIG. 1), and where, according to the invention, the enclosures (2) comprise at least three layers (4, 5, 6) (see FIG. 6) that are joined together with fasteners (7*a*, 7*b*, 7*c*) with discrete elastic elements, supporting at least a second layer (5) that is arranged in an intermediate position between the first (4) and the third layer (6). This document considers that the supporting layer has the properties of strength and rigidity to sustain itself and to provide a mounting and support for the rest of the elements. As mentioned later in this document by way of example, this second layer (5) can be made of mdf (medium-density fibreboard), PVC, metal etc., that are materials that are accredited to comply with these properties for themselves.

It is also foreseen that the system (1) (see FIGS. 2 to 5) can additionally comprise a structure (9) of beams (10), crossbars (11), and connectors (23, 25) to which would be fastened, at least, the second supporting layer (5), such that the said second layer (5) also cooperates in holding and squaring (maintain perfectly in position to the beams (10) and crossbars (11)) the structure (9). With this structure (9) it is possible to build larger constructions. The union of the second layer (5) to the structure (9) is made through fasteners that comprise some dowels.

The discrete elastic elements ideally comprise dowels (8) of an elastomer material (see FIGS. 4 to 6), while the fasteners (7*a*, 7*b*, 7*c*) would comprise some primary holes (7*a*) drilled in the second layer (5) and/or in the beams (10), crossbars (11), and connectors (23, 25) (see FIGS. 4 and 5) where appropriate, for insertion and fitting of these dowels (8), and/or some secondary holes (7*b*) drilled in the first layer (4) (see FIGS. 4 and 5) to fit these dowels (8), and/or some tertiary holes (7*c*) drilled in these dowels (8) for threading or insertion of stems (16) (see FIG. 5) for securing the third layer (6). Logically, such stems (16) also pass through the third layer (6) through some holes (50). With this configuration, with a single dowel (8) passing through the second layer (5) and, as appropriate, to the structural elements (9), and attached to the other two layers (4, 6), point fastenings are obtained—by simultaneously passing the dowels (8) through the primary holes (7*a*) drilled in the second layer (5) and through the structural elements (9) in the case of using them, and attaching them to the other two layers (4, 6) as well—that enhances the capabilities of the system (1) isolation. It is foreseen that the dowels (8) preferably comprise some extensions (8*a*) of smaller section to fit in the said secondary holes (7*b*) so that the widest part of the dowels (8) stops the insertion of the extensions (8*a*) at the first layer (4) obtaining a better finish and a more effective assembly. Furthermore, the dowels (8) and/or their extensions (8*a*) ideally have a cylindrical configuration.

Figure 4:
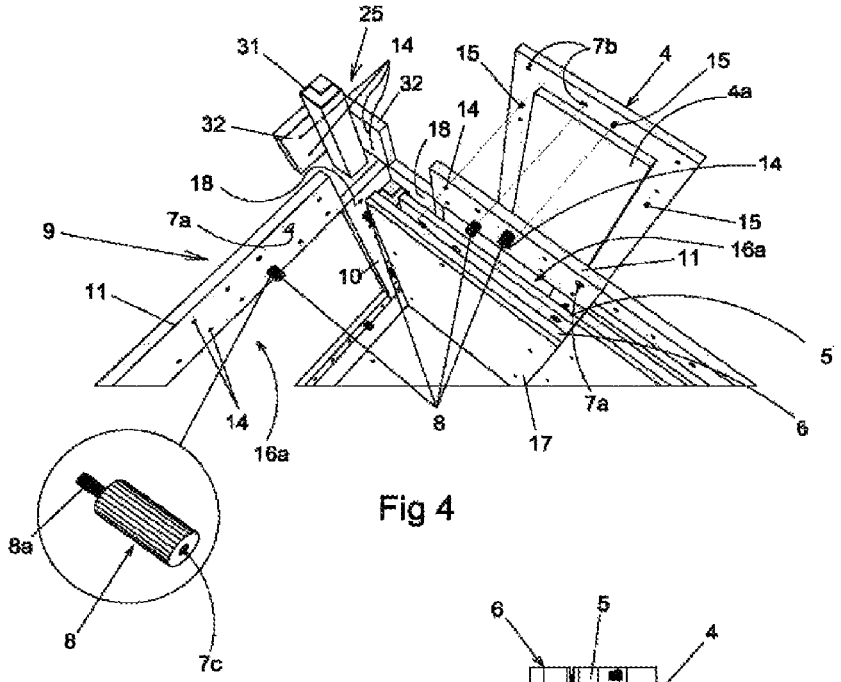
FIG. 4 shows a detail of the corner between walls, showing only the structure to the left and with the layers assembled to the right, or partially disassembled from the outer layer, similar to what is shown in FIG. 3. It also displays the magnified detail of a configuration dowel of a discrete elastic element.
Figure 6:
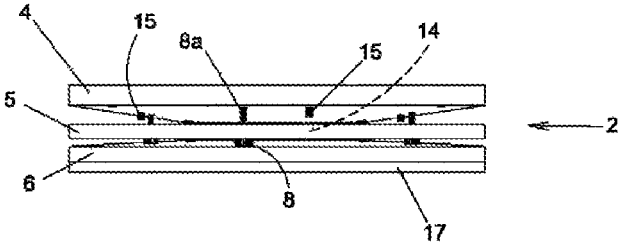
FIG. 6 shows a detail of the layers of the invention system, in an example that lacks the structure, and where the supporting layer is capable of structurally supporting the enclosure by itself.

To improve the assembly and centring between the second supporting layer (5)—or the structure (9) as the case may be—and the adjacent first layer (4), some indentations (14) are planned in the second layer (5) and/or in the beams (10), crossbars (11), and connectors (23, 25) of the structure (9), according to the invention, directed toward the first layer (4) (see FIG. 4), while nipples (15) are located in the first layer (4) directed toward such indentations (14) for introduction into them (see FIGS. 4 and 6). In the figures, these through-holes (14) cut through the element in which they are drilled, but the important aspect is that they are directed toward the first layer (4).

It is also foreseen that the first layer (4) could comprise some projections (4*a*) complementary to the holes (16*a*) generated between the beams (10) and/or crossbars (11) of the structure (9), to fit into them, also improving the rigidity and the isolating properties of the whole.

For its part, the first layer (4) is ideally made of mdf, 19 millimetres thick, the second layer (5) of 16-millimetre mdf, and the third layer (6) of 10-millimetre mdf, planks of wood derivatives with properties of flexibility, mass, and absorption that improve the isolation. Complementary or alternative to the above, any or all of the layers (4, 5, 6) could also be made of other suitable materials, such as plastic materials (PVC for example), and/or metal, etc.

It has also been considered that the first layer (4) and/or the third layer (6) could comprise an additional acoustic and/or bituminous membrane (17) on at least one of their faces that can be appreciated in the figures on the inside of the third layer (6). Furthermore, the third layer (6) can also incorporate a polyurethane agglomerate, that is not shown. It is also foreseen that the first layer (4) and/or the second layer (5) and/or the third layer (6) and/or the structure (9) could comprise a coating, not shown, of felt on at least one of their faces and/or edges with the purpose of sealing the joints between layers. With regard to the visible exterior and interior finish of the enclosures (2), this may be with the mentioned coating of felt, and/or could also be with raw wood, PVC, rubber, or metallic sheeting, aluminium, zinc, etc.

Figure 5:
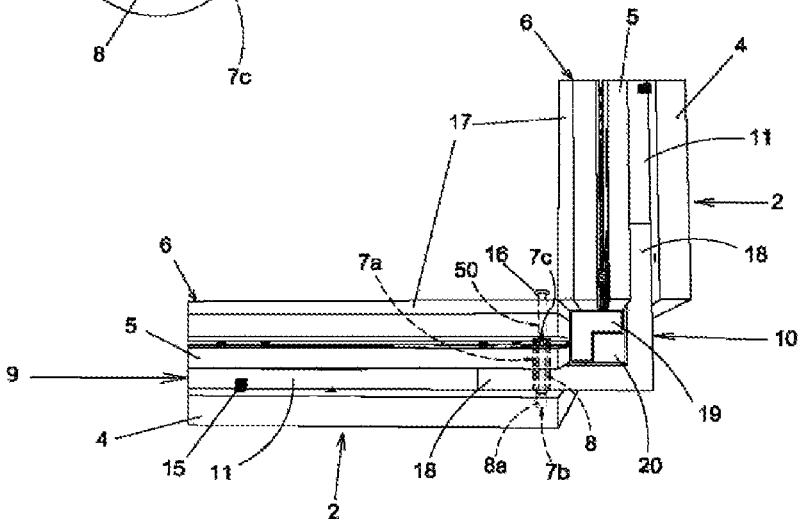
FIG. 5 shows a detail of the corner joint between two enclosures.
Figure 7:
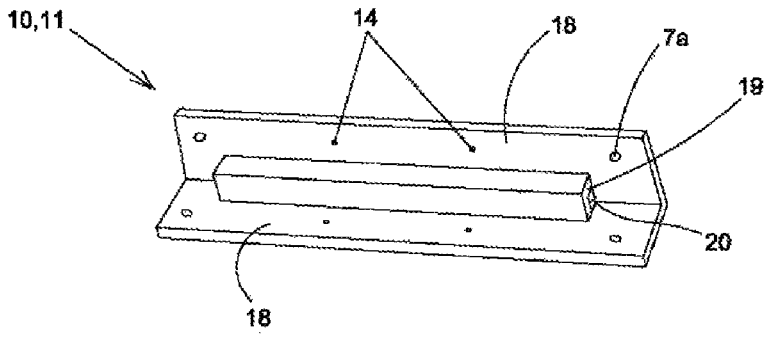
FIG. 7 shows a detail view of a beam or an angular crosspiece for a corner.
Figure 8:
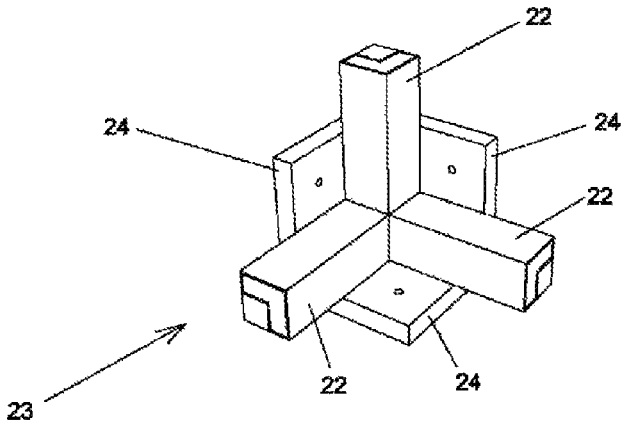
FIG. 8 shows a detailed view of a primary connector. This figure also shows how it comprises three secondary brackets that form a trihedron and three primary covers that are shorter than those brackets and that are related to two of them.

With regard to the structure (9), basically the beams (10) and crossbars (11) comprise end sections (18) at right angle to join in the corner as seen in FIGS. 4 and 5, and with more detail in FIG. 7, and in whose end sections (18) are located the indentations (14) and/or primary holes (7*a*), comprising the internal reinforcing primary brackets (19) between these end sections (18) and the internal support dowels (20) between the end sections (18) and the first brackets (19) (see FIGS. 5 and 7); while the connectors (23, 25), comprise a first connector (23) (see FIGS. 2 and 8) that comprises three secondary brackets (22) that form a trihedron and three shorter primary covers (24), that relate two on two to these secondary brackets (22), and a second connector (25) (see FIG. 4) that comprises a third straight bracket (31) with two second covers (32) that form a dihedral centred on the third bracket (31).

Sufficiently described the nature of the invention, as well as the embodiment in practice, it should be noted that the provisions referred to above and represented in the attached drawings are susceptible to modifications of detail as long as they do not alter the fundamental principle.

The invention claimed is:

1. Structural system with acoustic insulation properties that comprises modular mountable closure panels to configure a construction characterised in that the closure panels comprise at least a first layer, a second layer, and a third layer joined together by fasteners, where the second layer arranged in an intermediate position between the first and the third layer is a supportive layer fastened to a structure of beams, crossbars, and connectors, and where each fastener comprises an elastomeric dowel and primary, secondary, tertiary and quaternary holes, wherein the second layer and/or the beams, crossbars, and connectors contain some indentations directed toward the first layer, while the first layer contains nipples directed toward such indentations for introduction into them and to improve the assembly and centering, and wherein the primary hole is drilled in the second layer and/or the beams, crossbars and connectors for the insertion and fit of the dowel, the secondary hole is drilled in the first layer to receive said dowel, the tertiary hole is drilled in the dowel for threading of insertion of a stem for securing the third layer, and the quaternary hole is made in the third layer for the passage of the stem.

2. Structural system with acoustic insulation properties according to claim 1, wherein the dowels comprise extensions of smaller section to fit in the secondary holes.

3. Structural system with acoustic insulation properties according to claim 1, wherein the dowels and/or their extensions have a cylindrical configuration.

4. Structural system with acoustic insulation properties according to claim 1, wherein the first layer comprises projections complementary to cavities generated between the beams and/or crossbars of the structure, to fit into them.

5. Structural system with acoustic insulation properties according to claim 1, wherein the first layer is made of 19-millimetres thick mdf, the second layer of 16-millimetres thick mdf, and the third layer of 10-millimetres thick mdf.

6. Structural system with acoustic insulation properties according to claim 1, wherein some or all of the layers are made of plastic materials and/or metal.

7. Structural system with acoustic insulation properties according to claim 5, wherein the first layer and/or the third layer comprise an acoustic and/or bituminous membrane on at least one of their faces.

8. Structural system with acoustic insulation properties according to claim 5, wherein the third layer comprises a polyurethane agglomerate.

9. Structural system with acoustic insulation properties according to claim 1, wherein the first layer and/or the second layer and/or the third layer and/or the structure comprise a felt coating on at least one of their faces and/or edges.

10. Structural system with acoustic insulation properties according to claim 1, including a visible exterior and interior finish of the enclosures in felt, raw wood, PVC, rubber, metallic sheeting, aluminum, zinc.

11. Structural system with acoustic insulation properties according to claim 1, wherein the beams and crossbars comprise various end sections at right angles to form corner joints, and in which end sections are located indentations and/or primary holes, comprising the primary internal reinforcing brackets between these end sections and interior support dowels between the end sections and the primary brackets; while the connectors comprise a primary connector that comprises three secondary brackets that form a trihedron and three shorter primary covers that are related two on two to the said secondary brackets, and a secondary connector that comprises a straight tertiary bracket and two shorter covers that form a dihedral centered on the third bracket.

* * * * *